United States Patent [19]

Karnowsky et al.

[11] Patent Number: 4,652,710

[45] Date of Patent: Mar. 24, 1987

[54] MERCURY SWITCH WITH NON-WETTABLE ELECTRODES

[75] Inventors: Maurice M. Karnowsky, Albulquerque; Frederick G. Yost, Carlsbad, both of N. Mex.

[73] Assignee: The United States of America as represented by the United States Department of Energy, Washington, D.C.

[21] Appl. No.: 849,914

[22] Filed: Apr. 9, 1986

[51] Int. Cl.[4] ..... H01H 29/04; H01H 1/02

[52] U.S. Cl. ..... 200/235; 200/233; 200/182; 200/266; 200/267

[58] Field of Search ..... 200/235, 182, 233, 262, 200/265, 266, 267

[56] References Cited

U.S. PATENT DOCUMENTS

| | | | |
|---|---|---|---|
| 1,744,109 | 1/1930 | Phelan | 208/122 |
| 1,971,924 | 8/1934 | Walker | 200/235 |
| 2,133,986 | 10/1938 | Green | 200/235 |
| 3,644,693 | 2/1972 | Bitko | 200/266 X |

FOREIGN PATENT DOCUMENTS

| | | | |
|---|---|---|---|
| 1173162 | 7/1964 | Fed. Rep. of Germany | 200/266 |
| 49-32094 | 8/1974 | Japan | 200/233 |

*Primary Examiner*—Stephen Marcus
*Assistant Examiner*—Ernest G. Cusick
*Attorney, Agent, or Firm*—Armand McMillan; Albert Sopp; Judson R. Hightower

[57] ABSTRACT

A mercury switch device comprising a pool of mercury and a plurality of electrical contacts made of or coated with a non-wettable material such as titanium diboride.

9 Claims, 4 Drawing Figures

OPEN SWITCH

MERCURY SWITCH WITH NON-WETTABLE ELECTRODES

The U.S. Government has rights in this invention pursuant to Contract No. DE-AC04-76DT00789 between the U.S. Department of Energy and AT&T Technologies, Inc.

The present invention relates to liquid metal switches with electrodes which can be in or out of contact with a liquid metal pool. More particularly, the invention relates to mercury switches, in which the electrodes are often wetted by the liquid mercury, resulting in amalgam information.

BACKGROUND OF THE INVENTION

Conventional mercury switches generally consist of a pool of liquid mercury trapped within a closed vessel having electrical insulation among the conductive contacts or electrodes. The pool of liquid mercury establishes a conducting path between electrodes for certain switch orientations, depending upon the degree of imbalance within the vessel. Mercury switch electrodes are typically made of metals such as copper, which are easily wetted by liquid mercury and have a low electrical contact resistance. When the distance between the electrodes is small, the choice of copper as an electrode material is unsatisfactory. As a result of wetting, mercury amalgamates with the electrode metal and solid particles of mercury compounds form on the electrodes, thus modifying their switching characteristics, usually making the switch unreliable. In addition, these particles of mercury compounds can break off and enter or float in the liquid mercury pool, causing shorting between the electrodes.

Attempts have been made in the art of making mercury switches to solve the wetting problem, but none has been entirely successful. U.S. Pat. No. 1,971,924, to Walker, discloses the use of a chrome-iron material as its electrode coating. Iron, however, forms an iron-mercury amalgam that causes wetting. Walker, in fact, recognizes the wetting problem but relies on its being small in magnitude. Further, the presence of chromium could provide a very thin oxide which would not survive under abrasion or in a hydrogen environment. Experiments have indicated that stainless steel type 304 forms such an oxide and will be wetted under such circumstances.

U.S. Pat. No. 1,744,109, to Phelan, discloses the use of molybdenum as electrodes, and once again he accepts a small amount of wetting, as is discussed in the specification.

Specifically, when the electrode is made of the material mentioned above, it "does not *readily* amalgamate with or become wetted by the mercury and, therefore, *only a small film* of mercury, if any, adheres to the body portion 21" (Emphasis added). Actually, it is not the mercury that adheres; mercury compounds are formed.

In U.S. Pat. No. 2,133,986, Green depends upon two and one-quarter weight percent beryllium to impart non-wetting characteristics to copper. Green asserts that amalgamation is acceptable provided there is no dissolution of the electrode. This concept is rather flawed since dissolution cannot be avoided in the process of amalgamation.

Finally, U.S. Pat. No. 4,311,769, to Andreev et al., describes a situation where the electrodes are purposely wetted with a surface layer of mercury, a situation which would be intolerable for many applications due to the bridging that it ultimately causes.

Thus, in the background art related to mercury switches, two common ideas appear: (1) the problem of wetting is recognized, but is tolerated when small in magnitude, and (2) attempts are made to actually wet the electrodes, thus compromising the requirement of non-wettable electrodes.

SUMMARY OF THE INVENTION

It is a primary object of the present invention to provide a mercury switch with non-wettable electrodes.

It is a further object to provide a mercury switch in which the electrodes or conductive contacts are coated with a metallic compound that will eliminate the problem of amalgamation and the resulting bridging that occurs between a mercury pool and electrodes or conductive contacts.

The objects of the present invention are fulfilled by providing a mercury switch having a plurality of spaced conductive electrodes with contacts which are bridged by a mercury pool when the switch is closed and are free of the mercury pool when the switch is open. In the switch of the invention, the conductive electrodes are coated with titanium diboride or an equivalent material on the conductive electrodes forming the contacts. As a result, the wetting of the conductive contacts is precluded, thereby avoiding the undesired bridging of said contacts that occurs by the formation of a mercury meniscus between the electrodes when the switch is in the open position.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent from this detailed description to those skilled in the art.

BRIEF DESCRIPTION OF THE DRAWINGS

The present invention will become more fully understood from the detailed description given herein below and the accompanying drawings which are given by way of illustration only, and thus are not limitative of the invention.

DETAILED DESCRIPTION

Figure 1:
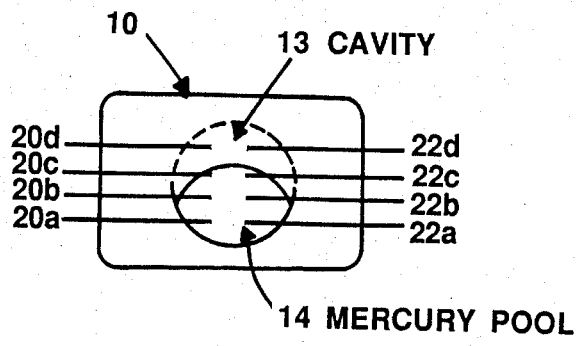
FIG. 1 is a diagrammatical view illustrating how a unique pin contact or electrode configuration determines a switch orientation according to the present invention.

FIG. 1 illustrates how a unique configuration of conductive contacts or electrodes 20 (*a–d*) and 22 (*a–d*) of the switch assembly 10 are opened or closed when a mercury pool 14 is trapped in cavity 13 having electrodes 20 (*a–d*) and 22 (*a–d*) protruding therein. When the switch assembly is tilted, an angular position of the switch assembly may be determined by the combinations of electrodes closed by the mercury pool 14. In FIG. 1, a circuit is closed between opposing electrodes 20 (*a* to *c*) and 22 (*a* to *c*) due to briding by the mercury pool 14. At the same time, opposing electrode 20D and 22D are in an open switch condition.

In a conventional mercury switch, the electrodes are generally formed of a material such as copper, which is easily wetted by liquid mercury. Mercury amalgamates with the copper and solid mercury compound particles form on the electrode, thus modifying its switching characteristics. These solid mercury compound particles can break off from the electrodes and enter the mercury pool, eventually causing shorting between the electrodes, as they flot on the mercury.

Figure 2A:
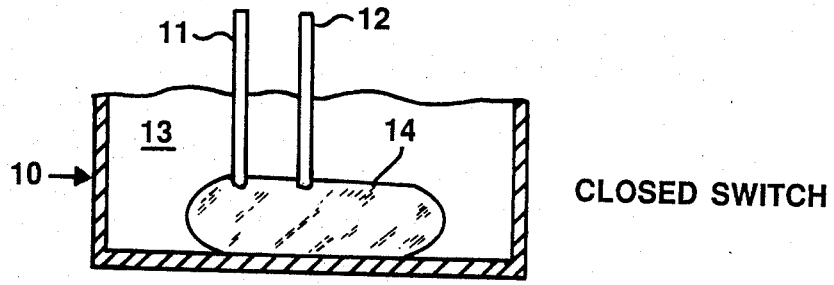
FIGS. 2*a* and 2*b* are frontal elevational views of a conventional mercury switch illustrating the bridging effect by a mercury pool, causing a normally open switch to be closed.
Figure 2B:
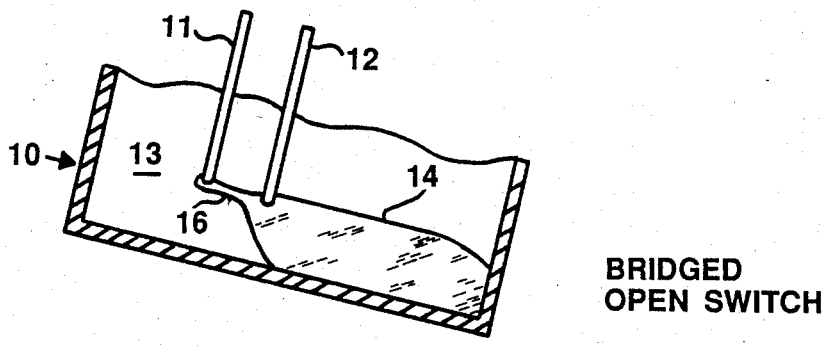

When the distance between the electrodes is small, bridging by a meniscus of mercury may occur. This effect is shown in FIG. 2*b*, in which capillarity (adhesion or cohesion among the molecules of mercury) causes the formation of a meniscus bridge 16 on an otherwise cohesive mercury pool 14. Bridging by the mercury meniscus 16 can cause a normally open switch to be closed. A closed switch orientation is shown in FIG. 2*a*, in which a first electrode 11 and a second electrode 12 are in a conductive mode due to a mercury pool 14 which closes the circuit. In a normally open switch orientation such as that shown in FIG. 2*b*, where the mercury switch is tilted, the mercury pool 14 forms meniscus bridge 16 to first electrode 11. Consequently, the switch remains closed although it is intended to be in the open condition.

Figure 2C:
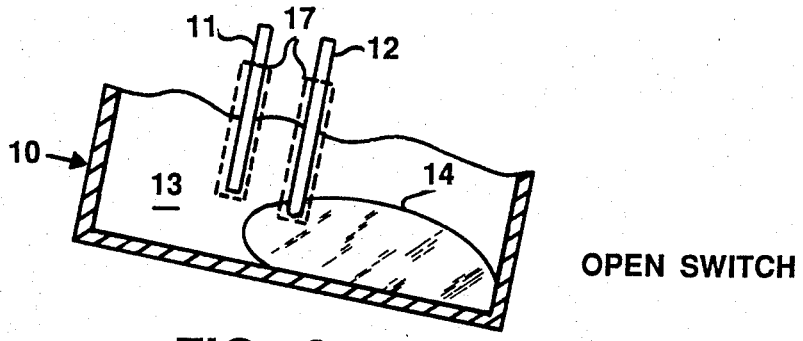
FIG. 2*c* is also a frontal elevation view of a mercury switch in which the electrodes have been coated according to the present invention with the result that the bridging effect shown in FIG. 2b has been eliminated.

FIG. 2*c* shows the switch of FIGS. 2*a* and 2*b*, in which electrodes 11 and 12 have been coated with a non-wettable to mercury material such as titanium diboride. When such a switch is tilted, as shown in the figure, no mercury meniscus forms between the pool and electrode 11, thus leaving the switching in the open position as intended.

The electrodes of the switches of the present inventions are preferably coated with titanium diboride or with a similar non-wettable electrically conductive compound. Titanium diboride is a good conductor (15–30 micro-ohms per centimeter) and is not wetted by mercury. As mentioned earlier, the electrodes may consist of a metal or metal alloy, e.g., copper or an alloy such as iron-nickel-cobalt (Kovar TM), or they may consist solely of solid titanium diboride. Other materials that may be used instead of titanium diboride include: the borides of all metals; the nitrides of titanium, zirconium, vanadium, niobium, and tantalum; and the silicides of titanium, zirconium, hafnium, vanadium, niobium, and tantalum. These compounds satisfy the requirement of low resistance and low wettability by mercury.

More particularly, usable compounds include;

$LaB_6$, TiB, $TiB_2$, $ZrB_2$, $ZrB_{12}$, $HfB_2$, VB, $VB_2$, NbB, $TaB_2$, CrB, $Mo_2B$, MoB, $Mo_2B_5$, $MoB_2$, and $W_2B_5$; TiN, ZrN, VN, NbN and TaN;

$Ti_5Si_3$, TiSi, $TiSi_2$, $Zr_2Si$, $Zr_5Si_3$, $ZrSi_2$, $HfSi_2$, $V_{3Si}$, $V_5Si_3$, $VSi_2$, $Nb_4Si$, $Nb_5Si_3$, $NbSi_2$, $Ta_5Si$, $Ta_2Si$, $Ta_5Si_3$, and $TaSi_2$.

The invention thus described may be varied in many ways. Such variations are not to be regarded as a departure from the spirit and scope of the invention, and all such modifications which would be obvious to one skilled in the art are intended to be included within the scope of the following claims.

What is claimed is:

1. In a mercury switch having a plurality of spaced conductive electrodes with contacts thereon which are bridged by a mercury pool when the switch is closed and free of said mercury pool when said switch is open, the improvement comprising:

contacts on said conductive electrodes formed of a material selected from the group consisting of metallic borides, nitrides and silicides, with the proviso that said silicides do not include the silicides of Cr, Mo, and W;

whereby mercury wetting of said contacts is precluded, thereby avoiding undesired bridging of said contacts in the open position of said switch.

2. The mercury switch of claim 1, wherein said conductive contacts are metallic electrodes with contacts coated thereon.

3. The mercury switch of claim 2, wherein said metallic electrodes are made of a transition group metal.

4. The mercury switch of claim 1, wherein said conductive electrodes have titanium diboride contact ends.

5. The mercury switch of claim 4, wherein said conductive electrodes are metallic electrodes and the titanium diboride contacts are coatings thereon.

6. The mercury switch of claim 5, wherein said metallic electrodes are made of an iron-nickel-cobalt alloy.

7. The mercury switch of claim 1, wherein said nitride is a nitride of Ti, Zr, V, Nb, or Ta.

8. The mercury switch of claim 1, wherein said silicide is a silicide of Ti, Zr, Hf, V, Nb, or Ta.

9. The mercury switch of claim 1, wherein said boride is a boride of La, Ti, Zr, Hf, V, Nb, Ta, Cr, Mo, or W.

* * * * *